US011603773B2

(12) United States Patent
Black et al.

(10) Patent No.: US 11,603,773 B2
(45) Date of Patent: Mar. 14, 2023

(54) TURBOMACHINERY HEAT TRANSFER SYSTEM

(71) Applicant: General Electric Company, Schenectady, NY (US)

(72) Inventors: Kenneth D. Black, Greenville, SC (US); David M. Johnson, Greenville, SC (US); Brett Darrick Klinger, Greenville, SC (US); George Martin Gilchrist, Greenville, SC (US)

(73) Assignee: General Electric Company, Schenectady, NY (US)

( * ) Notice: Subject to any disclaimer, the term of this patent is extended or adjusted under 35 U.S.C. 154(b) by 234 days.

(21) Appl. No.: 16/860,431

(22) Filed: Apr. 28, 2020

(65) Prior Publication Data

US 2021/0332718 A1 Oct. 28, 2021

(51) Int. Cl.

| | |
|---|---|
| ***F01D 25/10*** | (2006.01) |
| ***F01D 21/00*** | (2006.01) |
| ***F01D 21/12*** | (2006.01) |
| ***F01D 25/12*** | (2006.01) |
| ***F01D 25/14*** | (2006.01) |

(52) U.S. Cl.

CPC ..... *F01D 25/10* (2013.01); *F01D 21/003* (2013.01); *F01D 21/12* (2013.01); *F01D 25/12* (2013.01); *F01D 25/14* (2013.01); *F05D 2260/213* (2013.01); *F05D 2260/84* (2013.01); *F05D 2270/80* (2013.01)

(58) Field of Classification Search

CPC ..... F01D 21/00; F01D 21/003; F01D 21/12; F01D 25/10; F01D 25/12; F01D 25/14; F01D 25/26; F05D 2260/213; F05D 2260/84; F05D 2270/80

See application file for complete search history.

(56) References Cited

U.S. PATENT DOCUMENTS 4,482,293 A * 11/1984 Perry ..... F02C 7/20 415/113

4,584,836 A 4/1986 McClelland (Continued)

FOREIGN PATENT DOCUMENTS

EP 0537307 A1 4/1993

EP 2754859 A1 7/2014

(Continued)

OTHER PUBLICATIONS

European Patent Office, Extended EP Search Report for corresponding EP Application No. 21168681.1, dated Sep. 22, 2021.

*Primary Examiner* — Jesse S Bogue

(74) *Attorney, Agent, or Firm* — Fletcher Yoder, P.C.

(57) ABSTRACT

A heat management system for turbomachinery is provided. The heat management system includes a thermal delivery system configured to providing heating, cooling, or a combination thereof, to a turbomachinery. The thermal delivery system includes a first heat transfer conduit and a second heat transfer conduit. The second heat transfer conduit is disposed on the turbomachinery adjacent to the first heat transfer conduit. The heat management system additionally includes a controller operatively coupled to the thermal delivery system and configured to control the heating, the cooling, or the combination thereof, of the turbomachinery via the thermal delivery system.

17 Claims, 10 Drawing Sheets

(56) References Cited

U.S. PATENT DOCUMENTS

| | | | | |
|---|---|---|---|---|
| 5,131,230 | A | 7/1992 | Barton et al. | |
| 7,837,429 | B2 | 11/2010 | Zhang et al. | |
| 9,404,380 | B2 | 8/2016 | Welch et al. | |
| 9,494,081 | B2 | 11/2016 | Laurello et al. | |
| 9,708,980 | B2 | 7/2017 | Farley et al. | |
| 9,988,928 | B2 | 6/2018 | Popescu | |
| 10,100,699 | B2 | 10/2018 | Farkas et al. | |
| 10,760,444 | B2 * | 9/2020 | Terwilliger | F01D 11/24 |
| 10,920,592 | B2 * | 2/2021 | Friedman | F01D 25/285 |
| 2010/0034635 | A1 | 2/2010 | Erickson et al. | |
| 2010/0237060 | A1 * | 9/2010 | Novikov | H05B 1/0272 219/490 |
| 2010/0260598 | A1 | 10/2010 | Kirby | |
| 2013/0251500 | A1 | 9/2013 | Cheung et al. | |
| 2014/0193237 | A1 * | 7/2014 | Reiter | F01D 25/08 415/139 |
| 2014/0321984 | A1 | 10/2014 | Welch et al. | |
| 2014/0331637 | A1 | 11/2014 | Laurello | |
| 2015/0354454 | A1 * | 12/2015 | Farley | F02C 7/057 60/39.091 |
| 2016/0108756 | A1 * | 4/2016 | Farkas | F01D 25/14 415/177 |
| 2016/0305281 | A1 | 10/2016 | Ballard, Jr. et al. | |
| 2017/0002683 | A1 | 1/2017 | Geveci | |
| 2017/0268379 | A1 * | 9/2017 | Magee | F01K 23/06 |
| 2017/0268429 | A1 | 9/2017 | Kapadia | |
| 2017/0335714 | A1 | 11/2017 | Popescu et al. | |
| 2019/0284954 | A1 | 9/2019 | Doesburg | |

FOREIGN PATENT DOCUMENTS

| | | | |
|---|---|---|---|
| EP | 3012415 | A1 | 4/2016 |
| EP | 2952691 | B1 | 7/2017 |
| EP | 3569824 | A1 | 11/2019 |

* cited by examiner

TURBOMACHINERY HEAT TRANSFER SYSTEM

BACKGROUND

The subject matter disclosed herein relates to heat transfer systems and, more specifically, to heat transfer systems in turbomachinery.

Turbomachinery, such as gas turbine systems, may provide for the generation of power. For example, many gas turbine systems typically include a compressor section for compressing a working fluid, such as air, a combustor for combusting the compressed working fluid with fuel, and a turbine section for turning the combusted fluid into a rotative power. The compressed air is injected into the combustor, where it is combined with fuel to create combustion gases that expand as the combustion gases enter the turbine section. The expanded fluid is forced through the turbine section. The turbine section may then convert the expanded fluid into rotative power, for example, by a series of blade stages. The rotative power may then be used to drive a load, which may include an electrical generator for producing electrical power and which may be electrically coupled to a power distribution grid.

Turbomachinery may generate heat during operations. It may be useful to improve heat transfer of turbomachinery.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the present system may encompass a variety of forms that may be similar to or different from the embodiments set forth below.

In a first embodiment, a heat management system includes a thermal delivery system configured to providing heating, cooling, or a combination thereof, to a turbomachinery. The thermal delivery system includes a first heat transfer conduit and a second heat transfer conduit disposed on the turbomachinery adjacent to the first heat transfer conduit. The heat management system additionally includes a controller operatively coupled to the thermal delivery system and configured to control the heating, the cooling, or the combination thereof, of the turbomachinery via the thermal delivery system.

In a second embodiment, a method includes providing heating, cooling, or a combination thereof, to a turbomachinery via a first heat transfer conduit and a second heat transfer conduit included in a thermal delivery system, wherein the second heat transfer conduit is disposed on the turbomachinery adjacent to the first heat transfer conduit. The method further includes controlling the heating, the cooling, or the combination thereof, of the turbomachinery, via a controller operatively coupled to the thermal delivery system, to minimize or to eliminate positional changes, structural changes, or a combination thereof, in one or more components of the turbomachinery due to thermal energy.

In a third embodiment, a non-transitory computer readable medium includes executable instructions which, when executed by a processor, cause the processor to provide heating, cooling, or a combination thereof, to a turbomachinery via a first heat transfer conduit and a second heat transfer conduit included in a thermal delivery system, wherein the second heat transfer conduit is disposed on the turbomachinery adjacent to the first heat transfer conduit. The instructions further cause the processor to control the heating, the cooling, or the combination thereof, of the turbomachinery, via a controller operatively coupled to the thermal delivery system, to minimize or to eliminate positional changes, structural changes, or a combination thereof, in one or more components of the turbomachinery due to thermal energy.

BRIEF DESCRIPTION OF THE DRAWINGS

These and other features, aspects, and advantages of the present subject matter will become better understood when the following detailed description is read with reference to the accompanying drawings in which like characters represent like parts throughout the drawings, wherein.

DETAILED DESCRIPTION

Figure 2:
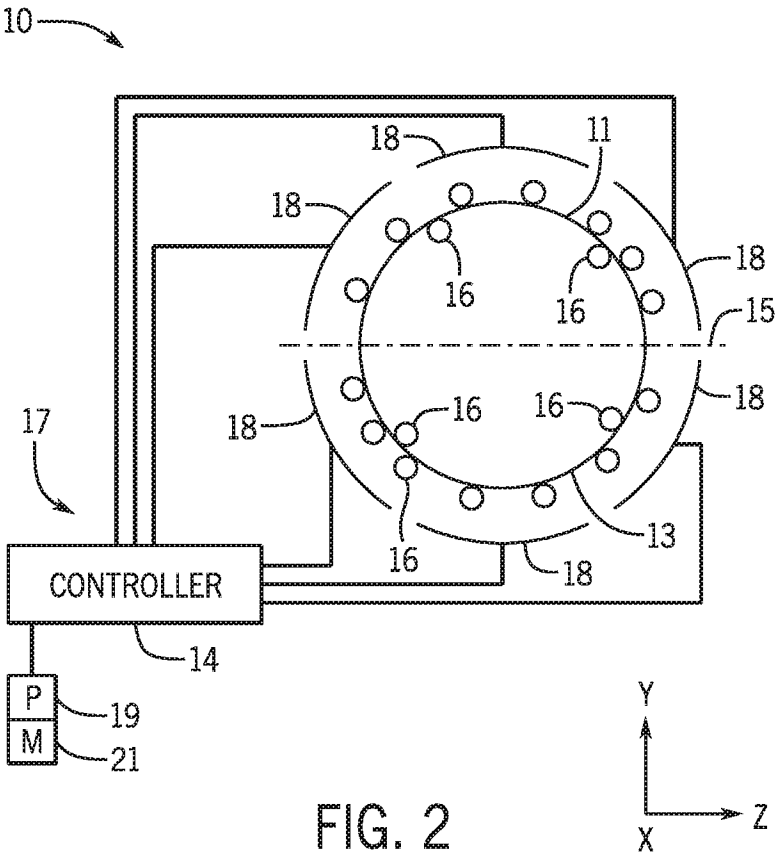
FIG. 2 is a block diagram forward looking aft view of an embodiment of a turbomachine having a thermal management system.

One or more specific embodiments of the present subject matter will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," "the," and "said" are intended to mean that there are one or more of the elements. The terms "comprising," "including," and "having" are intended to be inclusive and mean that there may be additional elements other than the listed elements.

The disclosed embodiments include a heat transfer or heat management system that may be used by a variety of turbomachinery. For example, a gas turbine system may include a heat management system that may provide heat and/or cooling to certain components, e.g., casings or shells of compressors, combustors, turbines, and so on, during certain operations, such as shutdown operations. For example, during shutdown operations, a lower shell of the gas turbine system may cool faster than an upper shell, which may lead to expansion/contractions of certain components, and consequent distortions of casing(s). The heat management system may provide heating and/or cooling to compensate for thermal differences, thus improving operations of the turbomachinery.

In one embodiment, the heat management system includes heat transfer conduits (e.g., wires, pipes) that may be routed symmetrically for improved heat transfer reliability. The heat transfer conduits may include certain gap ranges between the heat transfer conduits themselves as well as certain gap ranges relative to certain components of turbomachinery (e.g., casing) to improve the transfer of heat. The heat management system may further include reflective foils and an insulation cover. The reflective foils or other wrappers may also be used to moderately isolate a short length of heat transfer conduit with attached sensors (e.g., thermocouples) in addition to controlling a spacing between the heat transfer conduits and insulation. Single fastener techniques may be used to fasten the heat management system to the turbomachinery.

In some embodiments, the heat management system may include a controller communicatively coupled to one or more sensors, such as thermocouples, disposed in various portions of the turbomachinery (e.g., a gas turbine system). The controller may be operatively coupled to one or more heating and/or cooling systems disposed in the turbomachinery. The controller may use zone control to control heat and/or cooling of one or more zones in the turbomachinery.

In one embodiment, the zone control may include double redundant application of heat/cooling and/or double redundant sensing. For example, a first zone adjacent to a second zone may provide for heating and/or cooling redundancy to the second zone should the heating/cooling equipment in the second zone develop maintenance issues. Likewise, a first sensor disposed in a first zone, area, or subsystem of the turbomachinery may provide redundancy for a second sensor disposed in a second zone, area, or subsystem. For example, the first sensor may be disposed in a first subsystem and the second sensor may be disposed in a second subsystem, but by using the techniques described herein, the first sensor may provide for data useful in determining conditions of the second subsystem should the second sensor become inoperative. By providing heating systems with double redundant application of heat/cooling and/or double redundant sensing, the techniques described herein may increase operational life and efficiency of turbomachinery.

The mechanical systems described herein may enable a more even heating of certain components, e.g. casings, as well as provide for redundancy during heating operations. For example, thermal conduits may be provided, adjacent to other conduits. In one example, two conduits may be parallel but offset some small amount (e.g., between 0.25 inches and 5 inches) from each other. The conduits may also be adjacent to and/or abut against the casing. For example, the conduits may be 0 inches to 0.2 inches from the casing. A reflective foil may be used, to aid in thermal transfer, for example, by reflecting radiation and thus reducing heat transfer that may occur through radiation. In certain embodiments, a "wrap" may be used, to partially or fully enclose a conduit and/or a temperature sensor to improve temperature delivery and/or measurements, as further described below.

Figure 1:
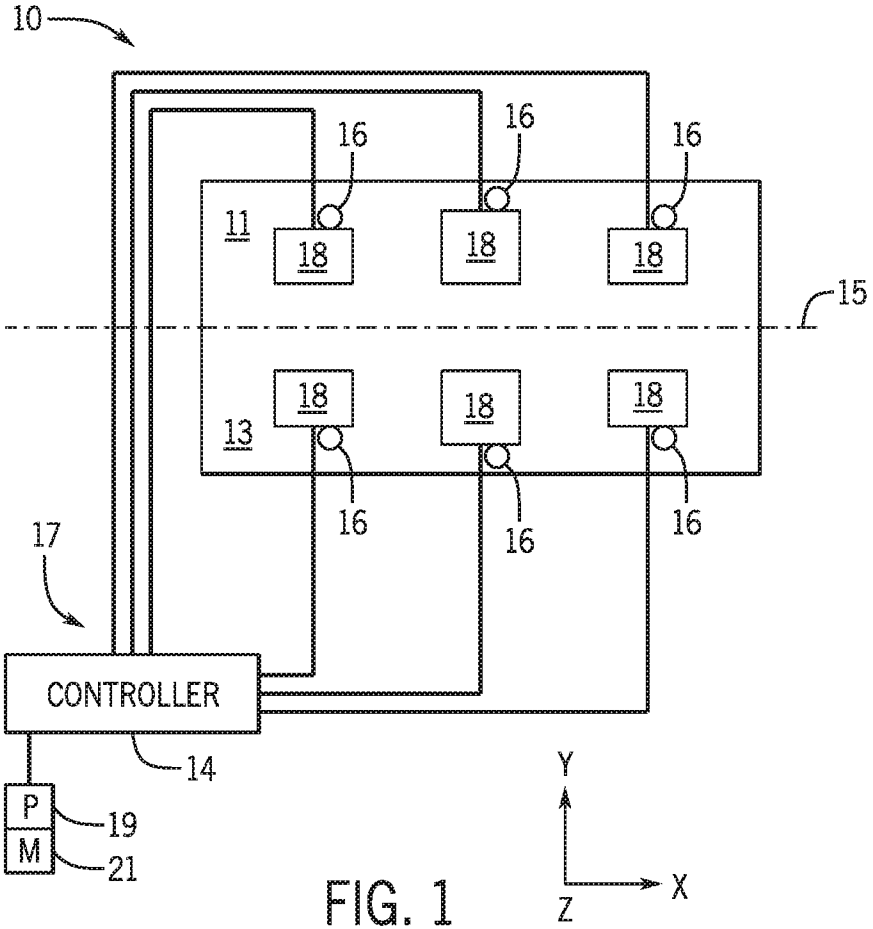
FIG. 1 is a block diagram side view of an embodiment of a turbomachine having a thermal management system.

Turning now to FIG. 1, the figure is a block diagram side view of a turbomachinery 10 having a top shell 11 and a bottom shell 13. A plane 15 divides the top shell 11 from the bottom shell 13. While the turbomachinery 10 is described below with respect to a gas turbine system, the turbomachinery 10 may be any type of turbomachinery, such as a turboexpander, a compressor, a rotary pump, a wind turbine, a hydroelectric turbine, and so on. In the depicted embodiment, a heat management system 17 is also shown. The heat management system 17 may include a control system 14 (also referred to herein as "controller 14"), sensors 16, and thermal delivery systems 18. The sensors 16 may be communicatively coupled to the control system 14 and transmit signals representative, of temperature, for example. Accordingly, the sensors 16 may include thermocouples, infrared sensors, thermistors, and the like. In certain embodiments, the sensors 16 may be disposed to provide signals representative of temperatures in various zones of the shells 11 and/or 13. Additionally, the sensors 16 may be sensors used by other systems of the turbomachinery 10. For example, sensors may be used for creep detection, clearance measures, stress measures, and so on.

The controller 14 may be operatively coupled to the thermal delivery systems 18 to provide for heating and/or cooling of certain zones within the turbomachinery 10, such as locations on the top shell 11 and the bottom shell 13. The thermal delivery systems 18 may include heating blankets (e.g., electrically heated blankets), heat exchangers (e.g., fluid-based heat exchangers), refrigeration systems, radiative heat systems, and so on, suitable for generating heat and/or removing heat.

In use, the turbomachinery 10 may experience heat gradients. For example, when the turbomachinery 10 is a gas turbine system, the bottom shell 13 may cool faster than the top shell 11 during shutdown. That is, as heat rises due to buoyancy, the bottom shell 13 may be at a lower temperature compared to the top shell 11, which may result in unwanted effects. For example, the bottom shell 13 may contract while the top shell 11 may expand, which may result in casing bending. The controller 14 may receive a plurality of signals from the sensors 16 representative of the temperature at each sensor 16 and apply certain heating and/or cooling via the thermal delivery systems 18, as described in more detail below, to minimize or eliminate certain heat-related effects, such as the casing bending. Accordingly, the controller 14 may include one or more processors 19 and memory 21. The memory 21 may store computer code or instructions executable by the processor(s) 19.

FIG. 2 is a block axial view of an embodiment of the turbomachinery 10, which illustrates sensors 16 placed on various locations of the turbomachinery 10. Because the figure includes like elements to FIG. 1, the elements are illustrated with like numbers. FIG. 2 further depicts the sensors 16 disposed on the top shell 11, on the bottom shell 13, as well as in a variety of locations of the turbomachinery 10. In some embodiments, the sensors 16 may be used with the heat management system 17.

For example, when the turbomachinery 10 is a gas turbine system, some of the sensors 16 may be used to provide for temperature and/or other measurements during operations of the turbomachinery 10. For example, the sensors 16 may include wheel space thermocouples, exhaust gas temperature thermocouples, compressor discharge temperature thermocouples, combustion temperature thermocouples, and so on. Additionally or alternatively, sensors that measure clearance (e.g., rotor clearance, clearance between two or more components) may be used.

The thermal delivery systems 18 may also be disposed on various locations of the turbomachinery 10. In one embodiment, the thermal delivery systems 18 may be disposed on the bottom shell 13 and used to heat the bottom shell 13 to provide for more equal heating of the top shell 11 and the bottom shell 13. That is, by heating the bottom shell 13 at one or more zones, the one or more zones of the bottom shell 13 may be kept at similar temperatures to areas of the top shell 11 that would have experienced more heat without the techniques described herein. By maintaining more optimized top-to-bottom temperature differences, the turbomachinery 10 may, for example, go through a shutdown cycle with minimal or no clearance eccentricity.

In other embodiments, thermal delivery systems 18 may be disposed on the top shell 11 as well as the bottom shell 13. In these embodiments, the thermal delivery systems 18 on the top shell 11 may provide for cooling, such as via heat exchangers (e.g., system with conduits that move a cooling fluid into a zone and leave with a heated fluid, thus extracting heat). By combining heating on the bottom shell 13 with cooling on the top shell 11, certain operations, such as turbine shutdown operations, may be improved while increasing the lifecycle of equipment.

In yet other embodiments, the thermal delivery systems 18 may provide both heating and cooling, for example, by circulating a heated fluid and a cooling fluid based on an amount of heat to be added or to be extracted. The thermal delivery systems 18 may be disposed on the shells 11, 13, or in any location of the turbomachinery 10 that would benefit from heat and/or cooling during certain operations. Indeed, the thermal delivery systems 18 may be disposed in various subsystems of the turbomachinery 10 and may be operatively coupled to the controller 14. The thermal delivery systems 18 may include electrically heated "blankets", heat exchangers, heat recuperators, radiative heaters, and so on.

Figure 3:
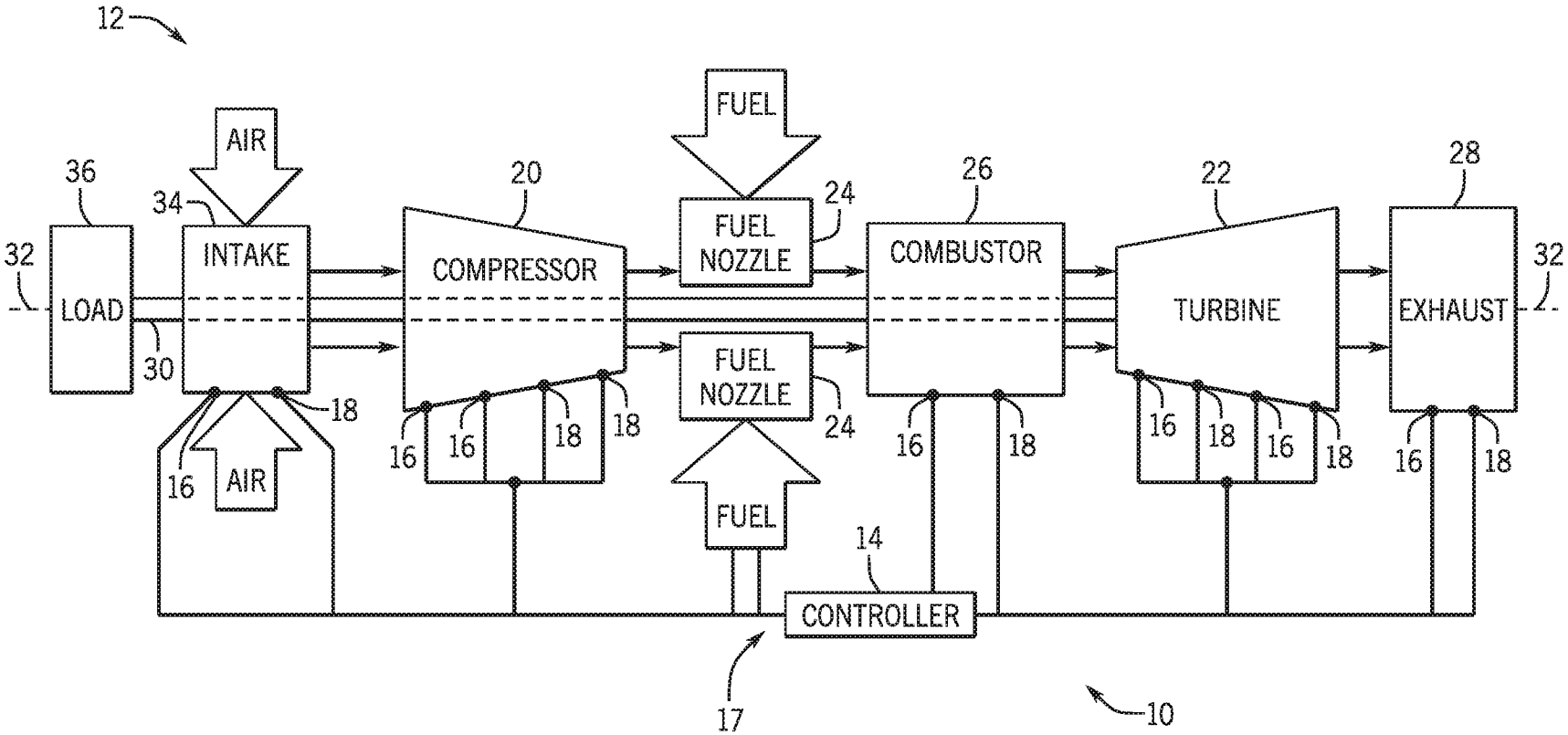
FIG. 3 is a block diagram of an embodiment of a gas turbine system of FIGS. 1 and 2 having a multi-stage axial compressor.

It may be beneficial to describe an embodiment where the turbomachinery is a gas turbine system. Accordingly, FIG. 3 is a block diagram of an embodiment of the turbomachinery 10 as a turbine system that may include a gas turbine engine 12 and the heat management system 17. The controller 14 is shown as communicatively coupled to the variety of sensors 16 and thermal delivery systems 18 disposed in various components of the gas turbine engine 12. Signals received via the sensors 16 may be used to derive thermal actions executable via the thermal delivery systems 18. The illustrated gas turbine engine 12 includes a compressor 20 (e.g., a multi-stage axial compressor or compressor section), a turbine 22 (e.g., a multi-stage turbine or turbine section), and fuel nozzles 24 coupled to one or more combustors 26 (e.g., a combustor section). The compressor 20 and turbine 22 each may have any number of rows or stages of rotor blades and stator vanes (e.g., 1 to 20).

In operation, the compressor 20 is configured to compress a compressible fluid (e.g., gas such as air, oxygen, and/or exhaust gas) and to deliver the compressed fluid to the fuel nozzles 24 and/or combustors 26. Although the compressible fluid may include any suitable gas, the following discussion may generally refer to the compressible fluid as an oxidant (e.g., air) as one non-limiting example. The fuel nozzles 24 are configured to supply fuel (e.g., from one or more fuel supplies) into the one or more combustors 26 (e.g., into combustion chambers), which combust the fuel with the oxidant (e.g., air) to generate hot combustion gases to drive the turbine 22.

The fuel nozzles 24 may be designed as pre-mix fuel nozzles 24 and/or diffusion fuel nozzles 24. Pre-mix fuel nozzles 24 mix the fuel with the oxidant (e.g., air) within the fuel nozzles 24 to create pre-mix type flames. Diffusion fuel nozzles 24 do not premix the fuel with the oxidant and thus create diffusion type flames when the fuel and air are separately introduced into the combustion zone. Regardless of the type of flames, the hot combustion gas flows from the combustors 26 into the turbine 22, thereby driving rotation of one or more stages of turbine blades coupled to a turbine rotor and shaft 30 along an axis 32. Eventually, the hot combustion gas exits the turbine 22 through an exhaust outlet 28 (e.g., exhaust stack, exhaust end).

In the illustrated embodiment, the shaft 30 is coupled to the compressor 20 and a load 36, such that rotation of the shaft 30 also drives rotation of the compressor 20 and the load 36. The compressor 20 may intake the oxidant (e.g., air) through an air intake 34, which may include filters, thermal control systems, or any other preconditioning systems. The load 36 may include an electrical generator, a rotary machine, a propulsion system of a vehicle, or any other suitable device. It is to be noted that the thermal management systems and methods described herein are also applicable to a two-shaft (or more) turbine with a load coupled to a power turbine that may be independent of a compressor and/or gas generator.

Figure 4:
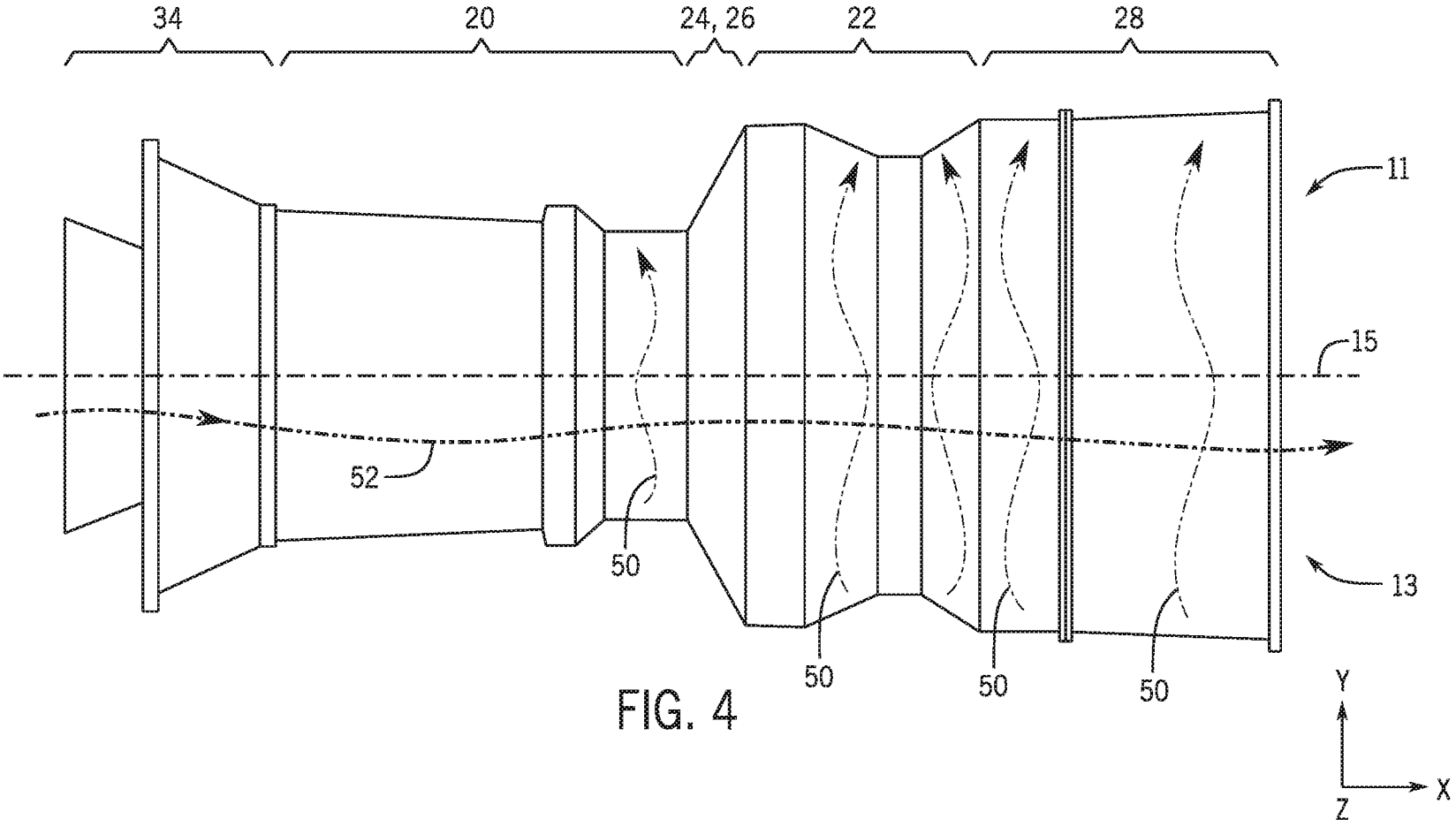
FIG. 4 is a side view of an embodiment of the gas turbine engine showing internal plumes of hot air.

During shutdown, heat may be removed from the bottom shell 13 at a faster rate than heat is removed from the top shell 11. Heat from the bottom shell 13 rises toward the top shell 11, as shown by arrows 50 in FIG. 4. More specifically, FIG. 4 is a side view of an embodiment of the gas turbine engine 12 (illustrated in FIG. 3) showing internal plumes of hot air 50 flowing from the bottom shell(s) 13 upwards towards the top shell(s) 11 as may occur, for example, during shutdown operations. Immediately after shutdown, the bottom shells 13 may be at about the same temperature when compared to the top shells 11, and a flow of air 52 (e.g., stack draft flow) may enter the gas turbine engine 12 through the intake section 34, move through the compressor section 20, the nozzles/combustor sections 24, 26, the turbine section 22, and exit through the exhaust section 28. As time increases, heat may be transferred from the bottom shells 13 into the top shells 11 via the internal plumes of hot air 50.

Figure 5:
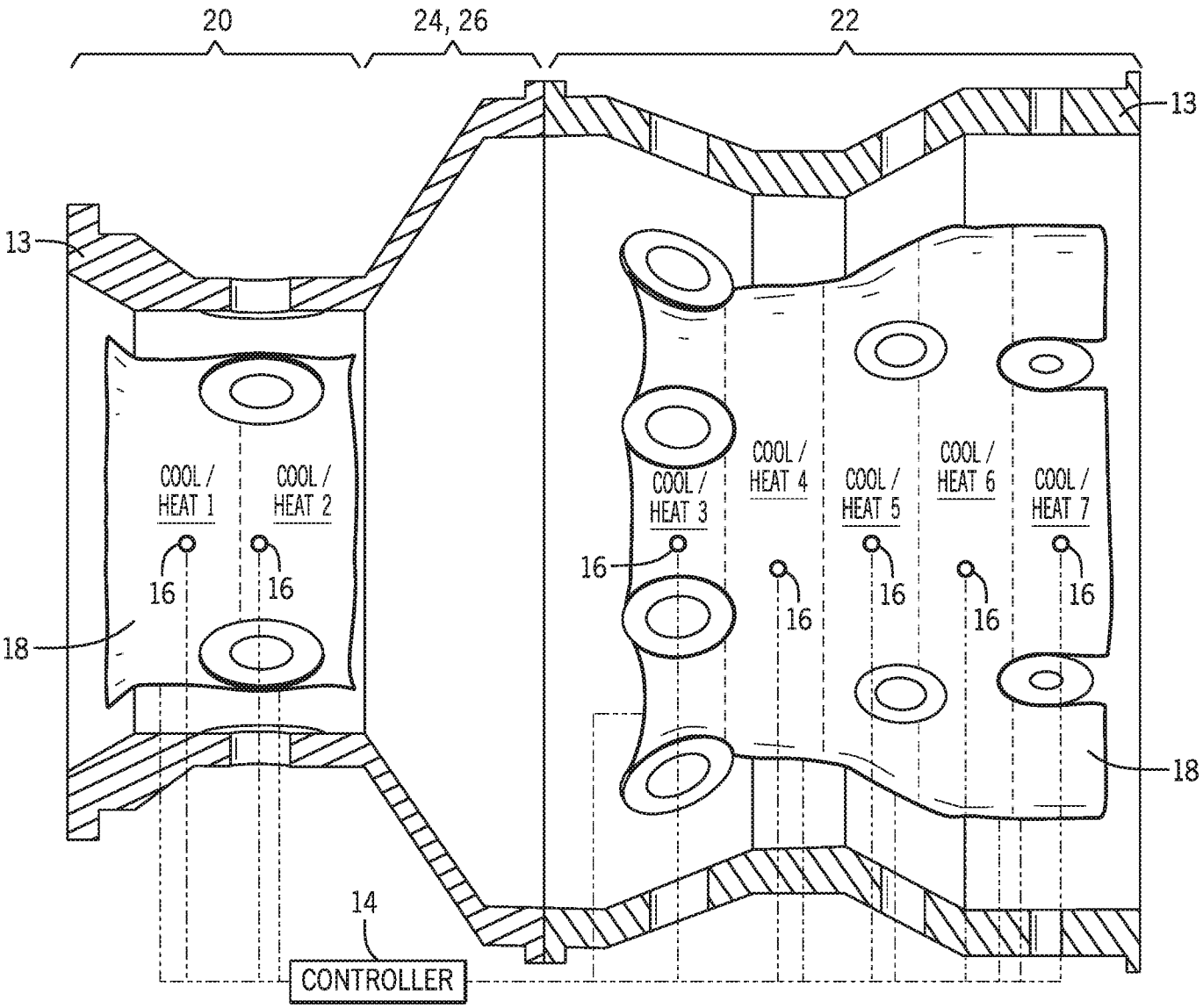
FIG. 5 is a schematic view of embodiments of two thermal delivery systems that may be disposed on bottom sections of shells of turbomachinery.

It would be beneficial to heat the bottom shells 13 and/or cool the top shells 11 to maintain more equal temperatures. Accordingly, the heat management system 17 (shown in FIG. 1) may apply heat and/or remove heat from certain zones, as illustrated in FIG. 5. More specifically, FIG. 5 is a schematic view of embodiments of two thermal delivery systems 18 that may be disposed on sections of the bottom shells 13. The thermal delivery system 18 disposed on the bottom shell 13, for example, of the compressor section 20, includes one heating and/or cooling zone in which two heating/cooling units 1, 2 are disposed. The thermal delivery system 18 disposed on the bottom shell 13 of the turbine section 22 includes two heating and/or cooling zones, a first zone in which heating/cooling unit 3 is disposed, and a second zone in which heating/cooling units 4, 5, 6, and 7 are disposed. Indeed, a zone may include one or more subzones with each subzone corresponding to a heating/cooling unit.

Zones and subzones may be selected for heating and/or cooling based on, for example, thermal studies that analyze the materials, thicknesses, manufacturing data, and/or geometries of the shells (e.g., shells 11, 13), subsystems (e.g., rotor 30, components of the intake section 34, compressor section 20, fuel nozzles 24, combustor 26, turbine 22, exhaust 28, and so on) to determine or otherwise model heat flows through the gas turbine engine 12. The heat flows may then be used to determine zones and subzones for heating and/or cooling. The heat flows may also be used to determine heating schedules for heating and/or cooling zones and/or subzones. For heating purposes, each heating/cooling unit may include an axial heating "strip" that may use electrical heating. Other heating embodiments may include heat exchangers, heat recuperators, radiative heaters, microwave heating elements, and so on. For cooling purposes, heat exchangers, refrigeration systems, and so on may be used.

In certain embodiments, each subzone (or zone having a single subzone) may be independently controlled by the controller 14. That is, the heating and/or cooling schedule may be provided for each subzone (or zone having a single subzone) that may be different for other subzones. In some embodiments, some subzones (e.g., adjacent subzones) may follow the same heating and/or cooling schedule. The heating and/or cooling schedule may be used to determine how much heating and/or cooling to apply at a given point in time (e.g., time following the start of shutdown).

Zones and/or subzones may also be used to provide redundant operations. For example, should a heating/cooling unit experience operating issues, adjacent heating/cooling units may enter into a redundancy mode where the adjacent heating/cooling units may provide added heating or cooling to compensate for the loss of heating or cooling of the heating/cooling unit experiencing the issue. In some embodiments, redundancy mode heating and/or cooling schedules may be provided, which may have been derived based on thermal analysis of a zone and/or subzone experiencing heating/cooling unit issues (e.g., failure of the heating/cooling unit).

That is, a redundancy mode heating and/or cooling schedule may be derived that increases heating and/or cooling for a given working zone and/or subzone based on issues experienced by adjacent zones and/or subzones. For example, the heating and/or cooling schedule may be used to apply heat and/or cooling via a time-based mode without using sensors. That is, the heating and/or cooling blanket may be turned on (at full power, partial power, or desired power level) for a given time to provide heat and/or cooling and then turned off without sensing temperature. Accordingly, the controller 14 may switch from normal operations to redundant operations, for example, by switching to using redundancy mode heating and/or cooling schedule(s).

Figure 6:
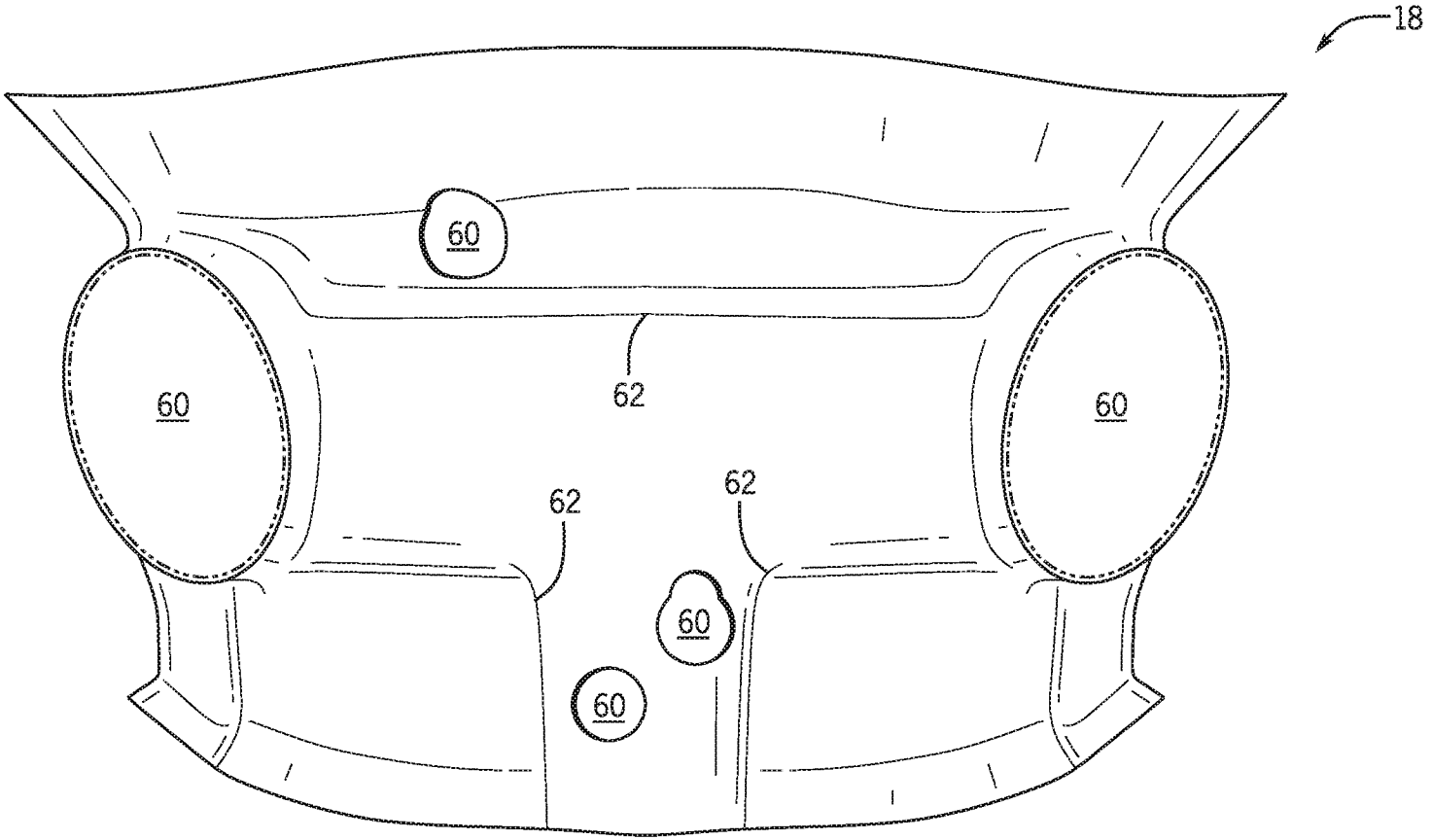
FIG. 6 is a perspective view depicting a heat blanket embodiment of one of the thermal delivery systems.

FIG. 6 is a perspective view depicting a heat blanket embodiment of one of the thermal delivery systems 18 illustrating the use of contouring and shape design to more conformably fit the thermal delivery system 18 onto, for example, an external portion of a shell such as the top shell 11 or the bottom shell 13. In the depicted embodiment, cutouts 60 may provide ready access to certain components (e.g., protruding nozzles, machinery inspection ports). Contours 62 may conformably follow underlying geometries of the shells 11 and/or 13 to improve fit (e.g., improve coverage by more closely following a variety of part geometries) and thus provide for enhanced heat transfer.

In some embodiments, the thermal delivery systems 18 may be added after installation of the turbomachinery 10. For example, the thermal delivery systems 18 may be provided as an after-install kit or as an upgrade kit and installed in situ. For example, the depicted heating blanket embodiment of the thermal delivery system 18 may be placed on exterior walls of the shells 11 and/or 13 and may be secured via fasteners, such as straps, nuts and bolts, welds, adhesives, and so on. Sensors 16 and conduits used to operate heating elements may then be connected to the controller 14. For example, the various conduits that may be used are described in FIG. 7 below.

Figure 7:
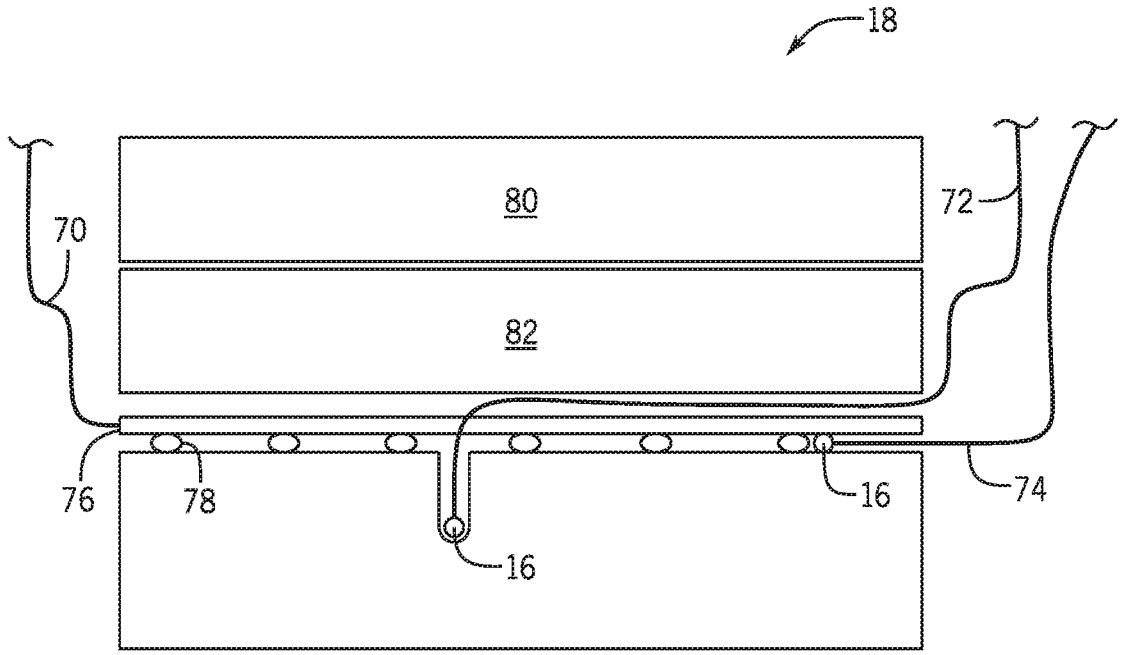
FIG. 7 is a front view of a block diagram depicting embodiments of conduits useful in operatively and communicatively coupling an embodiment of a thermal delivery system to a controller.

FIG. 7 is a front view of a block diagram depicting embodiments of conduits 70, 72, and 74 useful in operatively and communicatively coupling an embodiment (e.g., heat blanket embodiment) of the thermal delivery system 18 to the controller 14 (shown in FIG. 1). In the depicted embodiment, conduit 70 may be used to operate a heating blanket 76. For example, sending electric power through the conduit 70 may heat heating elements 78 included in the heating blanket 76. Insulation layers 80 and 82 may use to retain the heat being added.

In use, the controller 14 may receive from the sensor 16 signals that are representative of temperature in a zone of a shell (e.g., shown as embedded in a section of the bottom shell 13). Accordingly, the controller 14 may adjust electric power through the conduit 70 to raise or lower the heat provided by the thermal delivery system 18. While two insulation layers 80 and 82 are shown, one, three, four, or more layers may be used. The sensor 16 senses temperatures being delivered via the heating blanket 76, for example, to protect from overheating of the heating blanket 76 itself, and conveys such signals to the controller 14 via conduits 72, 74. It is to be understood that the heating blanket shown is but one embodiment of the thermal delivery system 18, and other embodiments may include heat exchangers and the like, suitable for adding heat to a zone.

Figure 8:
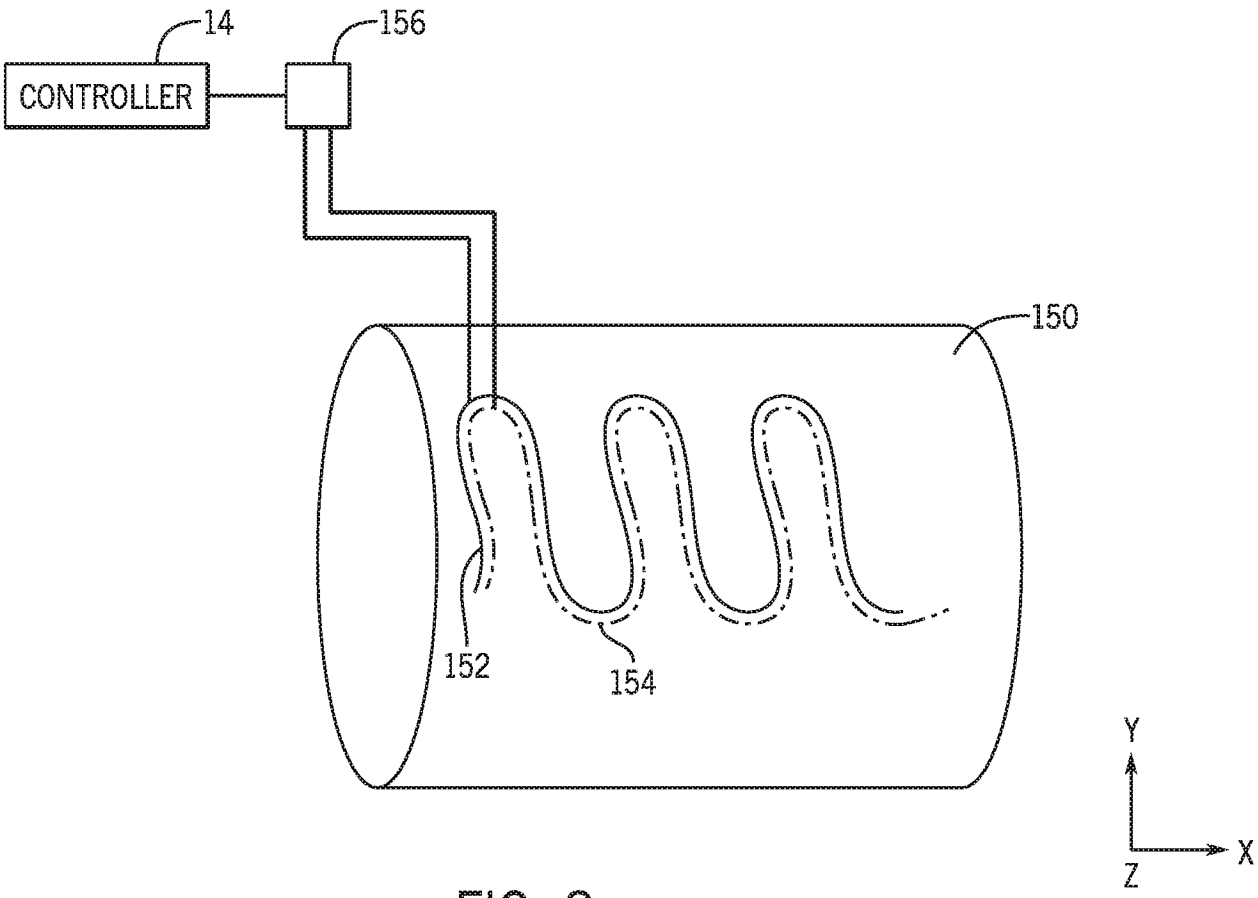
FIG. 8 is a bottom view of an embodiment of a shell or casing having a set of two heat transfer conduits disposed about in circumferential strips about an area of the casing.

Turning now to FIG. 8, the figure is a bottom view of an embodiment of a shell or casing 150 having a set of two heat transfer conduits 152, 154, disposed in circumferential strips about an area of the casing 150. The casing 150 may be, for example, comprised of the shells 11 and/or 13, as described above with respect to FIGS. 1, 2, and 5. The heat transfer conduits 152 and/or 154 may be pipes suitable for moving fluid or may be heating elements (e.g., wires), such as heating elements 78 previously described with respect to FIG. 7.

In the depicted embodiment, the heat transfer conduits 152, 154 are disposed alongside each other. That is, heat transfer conduit 152 may follow the same contours (e.g., curvature) as the heat transfer conduit 154, and the heat transfer conduits 152, 154 may be parallel with respect to each other and/or may be offset a certain amount from each other. In one embodiment, the heat transfer conduit 152 may be identical (e.g., have the same size and shape) to the heat transfer conduit 154 but may be placed offset and/or parallel to the heat transfer conduit 154. For example, the heat transfer conduits 152, 154 may be between 0.25 inches and 5 inches from each other. The heat transfer conduits 152, 154 may be placed to follow certain contours (e.g., blanket contours, casing contours) and may thus include curved portions. In certain embodiments, the conduits 152, 154 may cover a specified area in the circumferential direction (e.g., over an arc such as between + or −45°) to cover a zone or a subzone, such that loss of a zone or subzone would not cause lateral bending of the casing or shell.

In the depicted embodiment, the heat transfer conduits are operatively coupled to the controller 14 via a circuitry 156, such as a pulse width modulation (PWM) circuitry 156 and, more specifically, a silicon-controlled rectifier (SCR)-based circuitry. In operations, the PWM circuitry 156 may deliver three-phase power to each of the heat transfer conduits 152, 154, for example, at a voltage between 360-660 volts. Because of lateral symmetry, if heating issues arise in one of the heat transfer conduits 152, 154, the other heat transfer conduit 152, 154 is configured to provide redundancy of operations.

That is, should a heat transfer conduit 152 or 154 fail, the other heat transfer conduit 152 or 154 may still provide enough heat to continue operations (e.g., shutdown operations) of the gas turbine engine 12. For example, if a heat transfer conduit 152 fails, then neighboring heat transfer conduits 154 may adjust heating schedules (as mentioned earlier) to compensate for the loss of the heat transfer conduit 152 and continue operations to prevent rotor rubs. While the depicted embodiment shows two heat transfer conduits 152, 154, three, four, five, six, or more heat transfer conduits may be disposed laterally symmetrical with respect to each other. It is also to be noted that the heat transfer conduits 152, 154 (or more) may be disposed to cover desired areas of the casing 150, such as the zones and/or subzones described in the figures above.

Figure 9:
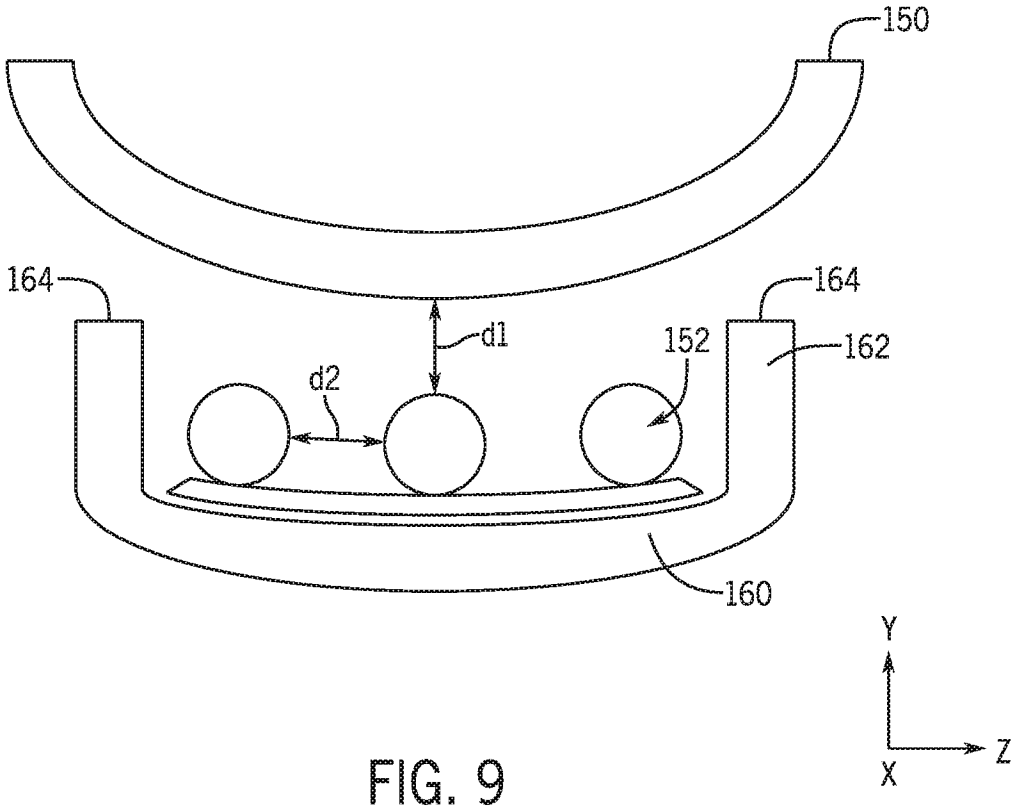
FIG. 9 is a side view of an embodiment of the shell or casing of FIG. 9 having a set of two heat transfer conduits disposed about in circumferential strips about an area of the casing.

Turning now to FIG. 9, the figure is a front sectional view of an embodiment of the casing 150, which illustrates further details of the heat transfer conduit 152 and other elements of the thermal delivery system as disposed about the casing 150. In the depicted embodiment, the heat transfer conduit 152 is disposed at a distance d1 from the casing 150. A distance d2 may also be used as an in-between distance separating the heating elements of the heat transfer conduit 152 from each other (or from the heat transfer conduit 154) as shown. The distance d1 may be between 0 to 0.2 inches. The distance d2 may be between 0.25 and 5 inches.

Also depicted is a reflective foil layer 160. The reflective foil layer 160 may reduce heat transfer through radiation by reflecting thermal radiation back toward the casing 150. The reflective foil layer 160 may also control a spacing between an insulation layer 162 and the heat transfer conduit 152. The heat transfer conduit 152 (optionally, 154) of the heat management system may be fastened onto the casing 150 via fasteners 164, such as nuts and bolts, screws, and so on.

Figure 10:
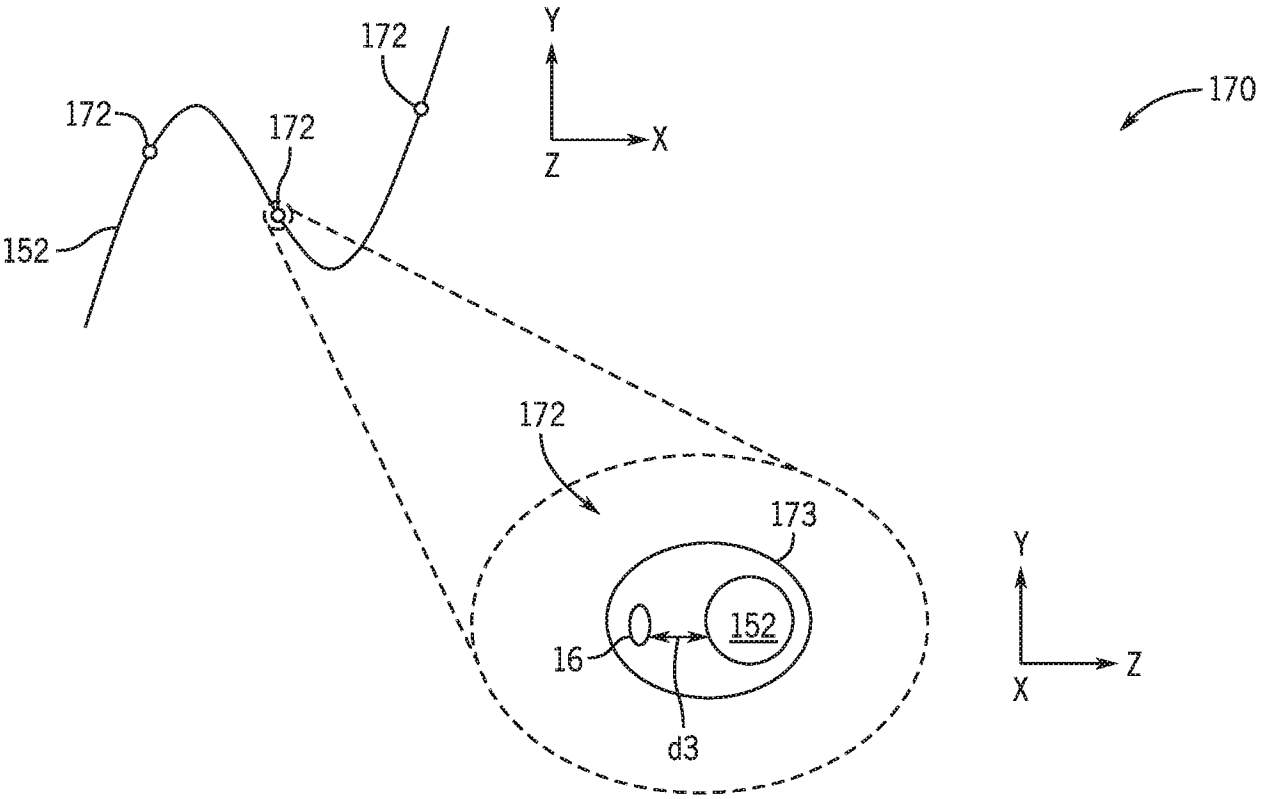
FIG. 10 is a front view of an embodiment of a wrapped heat transfer conduit and an adjacent sensor.

FIG. 10 is a diagram depicting an embodiment of a "wrapped" portion 172 disposed in the heat transfer conduit 152. In the depicted embodiment, a single wrap 173 may be used. For example, the wrap 173 may completely enclose both the heat transfer conduit 152 and the sensor 16 (e.g., thermocouple) in a portion of the heat transfer conduit 152. The length of the heat transfer conduit 152 that is wrapped may be between 1 inch and 5 inches, and the sensor 16 and the heat transfer conduit 152 may be separated from one another within the wrap 173 by a distance d3.

In one embodiment, each of the heat transfer conduits 152 may include one wrapped portion 172 disposed in the middle of the heat transfer conduit 152. For example, if a heat transfer conduit 152 has a length of 6 feet, then the wrapped portion 172 may be disposed in the middle, e.g., about three feet from the start of the heat transfer conduit 152. In other embodiments, a plurality of wrapped portions 172 may be disposed along the length of the heat transfer conduit 152. In some embodiments, each of the plurality of wrapped portions 172 may be disposed to divide the heat transfer conduit 152 into approximately equal or equal segments between the wrapped portions 172.

In the depicted embodiment, the wrap 173 may cover all sides of the heat transfer conduit 152 in a single layer and may also enclose the sensor 16. In use, the wrapped portion 172 may improve temperature sensing of the heat transfer conduit 152. For example, if the sensor 16 was not wrapped, the sensor 16 may not be as accurate in sensing the heat transfer conduit 152, as heat applied may be transferred into the casing and thus the sensor 16 may get a lower heat reading. Accordingly, the techniques described herein provide for improved thermal manipulation suitable for enhancing casing life and for minimizing and/or eliminating casing bends or distortions.

Figure 11B:
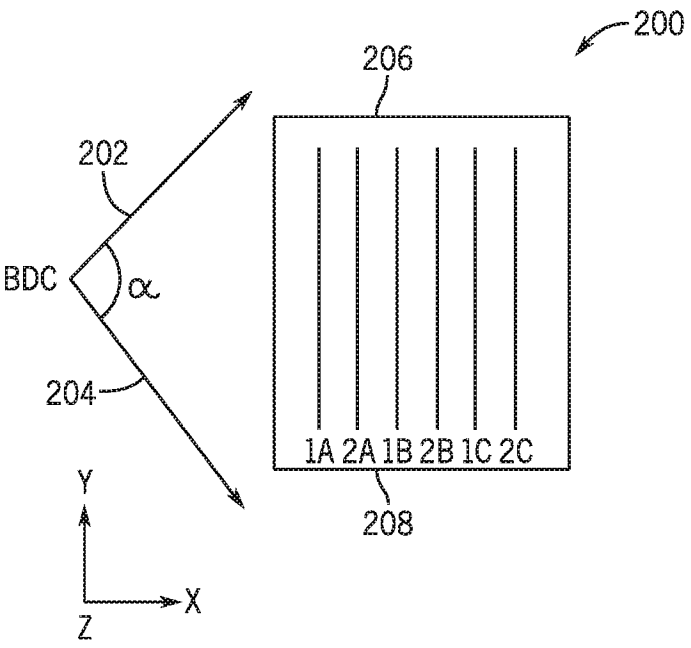
FIG. 11B illustrates a bottom block view of an area (e.g., bottom of casing) being heated via heating elements where phases A, B, and C have been interwoven.
Figure 11A:
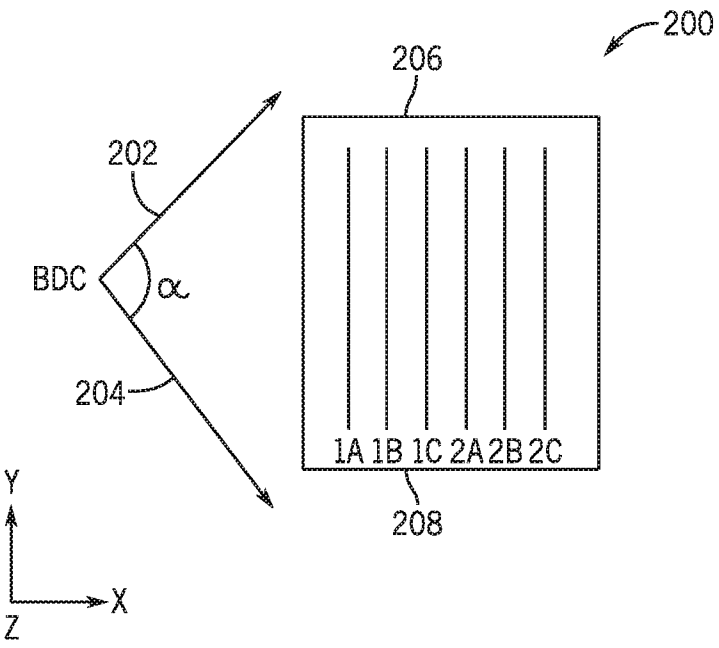
FIG. 11A depicts a bottom block view of an area (e.g., bottom of casing) being heated via two heating elements.

FIG. 11A depicts a bottom block view of an area 200 (e.g., bottom of casing) being heated via two heating elements. More specifically, the area 200 is bounded by two vectors 202, 204 that may intersect a bottom dead center (BDC) of the casing having an angle $\alpha$ of approximately 90° so that the area 200 provides a coverage from the middle of BDC of the casing to approximately 45° on either side of BDC (e.g., sides 206, 208). In certain embodiments, the angle $\alpha$ may be between 45° to 180°.

The heating elements may be three-phase heating elements having A, B, and C phases. In the depicted embodiment, 1A depicts heating element 1 phase A, 1B depicts heating element 1 phase B, and 1C depicts heating element 1 phase C. Likewise, 2A depicts heating element 2 phase A, 2B depicts heating element 2 phase B, and 2C depicts heating element 2 phase C. In some embodiments, each phase A, B, and C may be controlled independently, while in other embodiments phases A, B, and C may be controlled as one. In the latter embodiments, if a phase A, B, or C is found not to be functioning as desired, then all phases of the heating element may be turned off.

FIG. 11A illustrates lateral thermal symmetry because any issues with a heater (or heater's phase) should not result in uneven side-to-side heating (or cooling when the heaters are cooling systems, such as cooling fluid conduits). For example, turning off heater 1 simply results in less overall heating but side-to-side heating (e.g., heating along the Y axis) is not uneven or asymmetrical.

Because the heaters may completely traverse from one side (e.g., side 206) to the other side (e.g., side 208), then lateral heating symmetry is provided. That is, if a heater or heater phase is off, then no one side should heat (or cool) differently from the other. Indeed, rather than heat (or cool) via "patches" covering the area 200, the techniques described herein may heat (or cool) evenly from side to side, thus maintaining lateral symmetry. In embodiments where all three phases are controlled together, it may be beneficial to interweave certain of the phases, as shown in FIG. 11B.

More specifically, FIG. 11B illustrates an embodiment of heaters 1, 2 where phases A, B, and C have been interwoven. In the depicted embodiment, rather than dispose phase B of the first heater to follow phase A of the first heater, phase A of the second heater is disposed to follow phase A of the first heater. In the depicted embodiment of FIG. 12B, the order is now 1A, 2A, 1B, 2B, 1C, and then 2C. Accordingly, should the first heater (phases 1A, 1B, 1C) be turned off, for example, the second heater (phases 2A, 2B, 2C) may more uniformly heat the casing area 200. It is also to be understood that, in other embodiments, more than two heaters may be used, and the phases similarly interwoven, such as 1A, 2A, 3A, 1B, 2B, 3B, 1C, 2C, 3C, when three heaters (or coolers) are used.

This written description uses examples to disclose the subject matter, including the best mode, and also to enable any person skilled in the art to practice the subject matter, including making and using any devices or systems and performing any incorporated methods. The patentable scope of the subject matter is defined by the claims and may include other examples that occur to those skilled in the art. Such other examples are intended to be within the scope of the claims, if they have structural elements that do not differ from the literal language of the claims, or if they include equivalent structural elements with insubstantial differences from the literal language of the claims.

The invention claimed is:

1. A heat management system comprising:

a thermal delivery system configured to providing heating, cooling, or a combination thereof, to a turbomachinery, the thermal delivery system comprising:

a first heat transfer conduit; and a second heat transfer conduit disposed adjacent to the first heat transfer conduit;

a heat sensor disposed adjacent to a section of the first heat transfer conduit; and a controller operatively coupled to the thermal delivery system and communicatively coupled to the heat sensor, the controller configured to control the heating, the cooling, or the combination thereof, of the turbomachinery via the thermal delivery system based at least on readings from the heat sensor, wherein the section of the first heat transfer conduit comprises an insulating wrap that only encloses the section of the first heat transfer conduit and the heat sensor and that is in direct contact with the heat sensor and the section of the first heat transfer conduit.

2. The system of claim 1, wherein the second heat transfer conduit is disposed parallel to the first heat transfer conduit.

3. The system of claim 2, wherein the first heat transfer conduit is offset from the second heat transfer conduit by a distance between 0.25 inches and 5 inches.

4. The system of claim 1, wherein the first heat transfer conduit comprises a first electrically-powered heating element, and the second heat transfer conduit comprises a second electrically-powered heating element; and wherein the controller is configured to independently control the first electrically-powered heating element and the second electrically-powered heating element.

5. The system of claim 4, wherein the controller is configured to provide redundant operations by adjusting control of the first electrically-powered heating element when the second electrically-powered heating element is inoperative or by adjusting control of the second electrically-powered heating element when the first electrically-powered heating element is inoperative.

6. The system of claim 1, wherein the thermal delivery system comprises a radiant barrier layer disposed radially outward of the heat transfer conduit and a casing of the turbomachinery.

7. The system of claim 1, wherein the turbomachinery comprises a gas turbine engine; and wherein the controller is configured to control a shutdown operation of the gas turbine engine and to control the thermal delivery system during the shutdown operation.

8. A method comprising:

providing heating, cooling, or a combination thereof, to a turbomachinery via a first heat transfer conduit and a second heat transfer conduit included in a thermal delivery system, wherein the second heat transfer conduit is disposed on the turbomachinery adjacent to the first heat transfer conduit, and wherein a section of the first heat transfer conduit comprises an insulating wrap that only encloses the section of the first heat transfer conduit and a heat sensor and that is in direct contact with the heat sensor and the section of the first heat transfer conduit; and controlling the heating, the cooling, or the combination thereof, of the turbomachinery, via a controller operatively coupled to the thermal delivery system, to minimize or to eliminate positional changes, structural changes, or a combination thereof, in one or more components of the turbomachinery due to thermal energy, wherein the controller uses at least readings from the heat sensor to control the heating, the cooling, or the combination thereof.

9. The method of claim 8, wherein the second heat transfer conduit is disposed parallel to the first heat transfer conduit, is offset from the first heat transfer conduit, or a combination thereof.

10. The method of claim 8, wherein the first heat transfer conduit comprises a first electrically-powered heating element, and the second heat transfer conduit comprises a second electrically-powered heating element; and wherein the controller is configured to independently control the first electrically-powered heating element and the second electrically-powered heating element.

11. The method of claim 10, comprising providing redundant operations, via the controller, by adjusting control of the first electrically-powered heating element when the second electrically-powered heating element is inoperative or by adjusting control of the second electrically-powered heating element when the first electrically-powered heating element is inoperative.

12. The method of claim 8, wherein at least the first heat transfer conduit provides for a lateral symmetry for heating, for cooling, or a combination thereof, of a casing of the turbomachinery.

13. The method of claim 8, wherein the section is between 0.5 inches and 10 inches in length.

14. A non-transitory computer readable medium comprising executable instructions which, when executed by a processor, cause the processor to:

provide heating, cooling, or a combination thereof, to a turbomachinery via a first heat transfer conduit and a second heat transfer conduit included in a thermal delivery system, wherein the second heat transfer conduit is disposed on the turbomachinery adjacent to the first heat transfer conduit, and wherein a section of the first heat transfer conduit comprises an insulating wrap that only encloses the section of the first heat transfer conduit and a heat sensor and that is in direct contact with the heat sensor and the section of the first heat transfer conduit; and control the heating, the cooling, or the combination thereof, of the turbomachinery, via a controller operatively coupled to the thermal delivery system, to minimize or to eliminate positional changes, structural changes, or a combination thereof, in one or more components of the turbomachinery due to thermal energy, wherein the controller uses at least readings from the heat sensor to control the heating, the cooling, or the combination thereof.

15. The computer readable medium of claim 14, wherein the first heat transfer conduit and the second heat transfer conduit provide for a lateral symmetry for heating, for cooling, or a combination thereof, of a casing of the turbomachinery.

16. The computer readable medium of claim 14, wherein the controller is configured to control the second heat transfer conduit when the temperature sensor detects that the first heat transfer conduit is inoperative.

17. The computer readable medium of claim 16, wherein the controller is configured to use zone control to control the second heat transfer conduit when the temperature sensor detects that the first heat transfer conduit is inoperative.

* * * * *